United States Patent [19]

Inoue

[11] Patent Number: 4,654,297

[45] Date of Patent: Mar. 31, 1987

[54] SILVER SALT DIFFUSION TRANSFER ELEMENT COMPRISING TWO SILVER HALIDE LAYERS

[75] Inventor: Noriyuki Inoue, Kanagawa, Japan

[73] Assignee: Fuji Photo Film Co., Ltd., Kanagawa, Japan

[21] Appl. No.: 772,684

[22] Filed: Sep. 5, 1985

[30] Foreign Application Priority Data

Sep. 14, 1984 [JP] Japan ..... 59-193454

[51] Int. Cl.[4] ..... G03C 5/54; G03C 1/46

[52] U.S. Cl. ..... 430/509; 430/230

[58] Field of Search ..... 430/230, 229, 227, 509

[56] References Cited

U.S. PATENT DOCUMENTS

| | | | |
|---|---|---|---|
| 2,373,732 | 4/1945 | Wolfson | 430/509 |
| 3,353,957 | 11/1967 | Blake et al. | 430/230 |
| 3,737,317 | 6/1973 | Nicholas et al. | 430/509 |
| 3,846,135 | 11/1974 | Hellmig et al. | 430/509 |
| 4,401,753 | 8/1983 | Vaes et al. | 430/230 |

*Primary Examiner*—Richard L. Schilling

*Attorney, Agent, or Firm*—Burns, Doane, Swecker & Mathis

[57] ABSTRACT

This invention provides a high sensitivity photosensitive element used for a silver salt diffusion transfer process and capable of producing an image having fine graininess and good quality. The photosensitive element comprises a photosensitive emulsion layer containing silver halide grains having small grain size (S layer) and another photosensitive emulsion layer containing silver halide grains having large grain size (L layer), the S layer being positioned toward the exposure side of the L layer, and the amount of silver halide contained in the S layer, the amount thereof contained in the L layer and the total amount thereof being 60–5 wt %, 40–95 wt %, and no less than 80 wt %, respectively, relative to the total amount of silver halide contained in the photosensitive element.

10 Claims, No Drawings

SILVER SALT DIFFUSION TRANSFER ELEMENT COMPRISING TWO SILVER HALIDE LAYERS

BACKGROUND OF THE INVENTION

1. Field of the Invention

This invention relates to a photosensitive element used for a silver salt diffusion transfer process and capable of providing an image of good quality.

2. Prior Art of the Invention

Processes for forming an image by silver salt diffusion transfer are well-known. A general example of the procedure of the process is as follows. An exposed photosensitive silver halide emulsion layer is first processed with an aqueous alkaline solution containing a developing agent and a silver halide solvent. The exposed silver halide grains are reduced to silver by the developing agent, while the unexposed silver halide grains are converted to a transferable silver complex salt by the silver halide solvent. This silver complex salt is diffused and transferred by inhibition to a layer containing silver-precipitating nuclei (an image-receiving layer) laid over the emulsion layer, where the silver complex salt is reduced by the developing agent with the aid of the silver-precipitating nuclei, to provide a silver image.

In practicing this process, there is usually used a film unit which comprises a combination of (i) a photosensitive element containing a layer of photosensitive silver halide emulsion on a support, (ii) an image-receiving element which includes an image-receiving layer containing silver-precipitating nuclei on a support, and (iii) a processing element which consists of a breakable container which holds a viscous aqueous alkaline solution containing a developing agent, a silver halide solvent, and a thickener. The emulsion layer of the photosensitive element (i) is first exposed, then the photosensitive element is placed over the image-receiving element in such a way that the emulsion layer is against the image-receiving layer of the image-receiving element (ii), and these layers are passed between a pair of rollers so that the processing elment (iii) is broken and the viscous aqueous alkaline solution it contains can spread, and are then allowed to stand for a predetermined time. The image-receiving element (ii) is then peeled off the photosensitive element (i) to provide a print comprising the image-receiving layer in which the desired image has been formed.

As for the image-receiving element used for the silver salt diffusion transfer process, Japanese Patent Publication No. 32754/1969 discloses an image-receiving element prepared as follows. A silver-precipitating agent is added to an alkali non-permeability polymer by vacuum metallizing and thereafter, such a polymer is dissolved in the solvent in order to be applied to a support. After drying, a chemical treatment such as hydrolysis is applied to the surface layer of such a polymer so that the surface layer has an alkali permeability, whereby an image-receiving element is prepared. Japanese Patent Publication No. 49411/1976 also discloses a method in which during or after oxidazation of a cellulose ester layer, a silver-precipitating agent is embedded in such an ester layer. U.S. Pat. No. 3,671,241 discloses another method in which an image-receiving layer is prepared by saponificating a cellulose ester layer containing a silver-precipitating agent.

On the other hand, for the purpose of obtaining a high quality image by making the grains of the formed image fine, it is well known to use silver halide grains of fine grain size. In particular, for making an ordinary black and white negative photosensitive material, silver halide grains of large grain size and small grain size are used and the emulsion layer containing the silver halide grains of large grain size is provided toward the exposure side from the emulsion layer containing the silver halide grains of small grain size. Although the above-mentioned method has been applied for preparing photosensitive materials for image formation by the silver salt diffusion transfer process, it is not capable of providing a high-sensitivity photosensitive element. Accordingly, an image having fine graininess could not be obtained.

SUMMARY OF THE INVENTION

Under such circumstances, the present invention was accomplished on the basis of the discovery that, as a specific phenomenon for image formation by the silver salt diffusion transfer process, a high sensitivity photosensitive element and an image having fine graininess and high quality cannot be obtained without combining three factors, i.e., employing an emulsion layer containing silver halide grains of small grain size and another emulsion layer containing silver halide grains of large grain size, positioning said two layers in special positions, and specifying the amount of silver halide contained in both said layers.

It is, therefore, a primary object of the present invention to provide a photosensitive element used for the silver salt diffusion transfer process which is highly sensitive.

Another object of this invention is to provide a photosensitive element which produces an image having fine graininess and good quality.

These and other objects of this invention will be clear from the following description.

In accordance with the present invention, there is provided a photosensitive element used for silver salt diffusion transfer process, which comprises a photosensitive emulsion layer containing silver halide grains of small grain size (this layer is hereinafter referred to as the S layer) and another photosensitive emulsion layer containing silver halide grains of large grain size (this layer is hereinafter referred to as the L layer), the S layer being positioned toward the exposure side from the L layer, and the amount of silver halide contained in the S layer, the amount thereof contained in the L layer and the total amount thereof contained in the S and L layers being 60–5 weight %, 40–95 weight %, and no less than 80 weight %, respectively, relative to the total amount of silver halide contained in the photosensitive element.

DESCRIPTION OF THE PREFERRED EMBODIMENTS

In the present invention, the S layer and the L layer are formed from an emulsion containing silver halide grains and a vehicle. As a vehicle, there can generally be used, for example, gelatin or the like, described in Research Disclosure vol 176, 17643, P26 (published in December 1978), "Vehicles and vehicle extenders".

As the silver halide grains contained in the S layer, there can be used silver halide grains having an average grain size of between 0.15 and 0.70 μm, preferably between 0.30 and 0.70 μm. Although the grain size distribution thereof is not particularly limited, it is preferable to use silver halide grains having such a grain size distribution that the (S/γ) value is less than 0.3, said value being obtained by dividing the standard deviation (S) by the average grain size (γ). The thickness of the S layer is in the range of about 0.2 to about 5 μm, preferably about 0.3 to about 3 μm, on the basis of the thickness of the dried layer. In the S layer, gelatin can be contained in such amount that the weight ratio of silver halide to gelatin is from 2/1 to 1/12, preferably from 1/1 to 1/10. The S layer can be formed to have a weight of about 0.2 to about 5 g/m$^2$, preferably about 0.3 to 3 g/m$^2$, on the basis of the weight of the dried S layer.

On the other hand, as the silver halide grains contained in the L layer, there can be used silver halide grains having an average grain size of between 0.80 and 3.0 μm, preferably between 0.8 and 1.7 μm. The silver halide grains contained in the S layer and the L layer are preferably used so that the difference between the average grain sizes thereof is no less than 0.30 μm. The thickness of the L layer is in the range of about 1 to about 10 μm, preferably about 2 to 7 μm. The L layer also contains gelatin in such amount that the weight ratio of silver halide to gelatin is from 2/1 to 1/12, preferably 1/1 to 1/10. The L layer can be formed to have a weight of about 2 to about 10 g/m$^2$, preferably about 3 to 7 g/m$^2$, on the basis of the weight of the dried L layer.

Although silver iodide or silver bromide can be used as the silver halide contained in the S layer and the L layer, the silver halide in the S layer contains 0 to 12 mol%, preferably 3 to 10 mol%, of iodine relative to silver ion (the same hereinafter), and silver halide in the L layer contains 1 to 12 mol%, preferably 4 to 10 mol% of iodine.

The silver halide grains in the emulsion can be of any of a variety of shapes such as those having regular crystal forms such as cubic and octahedral, those having irregular crystal forms such as spherical and tabular, as well as combinations of these crystal forms. They can consist of various shaped grains. The interior of the silver halide grains each can have a different phase than the surface layer, and the silver halide grains also can consist of a homogeneous phase. The silver halide grains can be those in which a latent image is formed chiefly on their surfaces, or may be those in which the latent image is formed chiefly within the grains. However, grains in which the latent image is formed on their surfaces are preferable.

The emulsion containing silver halide (referred to as the photographic emulsion) used in the present invention can be prepared by using processing described in *Chimie et Physique Pholographique,* by P. Glafkides (published by Paul Montel Co., Ltd., 1967); *Photographic Emulsion Chemistry,* by G. E. Duffin (published by the Focal Press, 1966); *Making and Coating Photographic Emulsion,* by V. L. Zelikman, et al., (published by the Focal Press, 1964); etc. Namely, any acidic, neutral or ammonia method may be used, and when reacting a soluble silver salt with a soluble halogen salt, it is possible to use either the single-jet method or the double jet method, or a combination thereof. It is also possible to use a method in which grains are formed in the presence of an excess of silver ions (the so-called reverse mixing method). A method in which the pAg in the liquid phase in which the silver halide is formed is kept constant, i.e., the so-called controlled double-jet method, can also be used as one forms of the simultaneous mixing method.

During the formation of silver halide grains or of their physical ripening, it is possible to use cadmium salts, zinc salts, lead salts, thallium salts, iridium salts or iridium complex salts, rhodium salts or rhodium complex salts, iron salts or iron complex salts, etc.

After precipitation or physical ripening, soluble salts are usually removed from the photographic emulsion. As a method for this, the well-known noodle washing process carried out after the gelatin of gelation may be used. There can be used a flocculation method utilizing an inorganic salt which has polyvalent anions (for example, sodium sulfate), an anionic surfactant, an anionic polymer (such as polystyrenesulfonic acid), a gelatin derivative (such as an aliphatic-acylated gelatin, an aromatic-acylated gelatin or the like). It is also possible to omit the step of removing the soluble salts.

Although the photographic emulsion can be prepared by using an emulsion that is not subjected to chemical sensitization, i.e., a so-called primitive emulsion, it is usually a chemical sensitized emulsion. When chemical sensitization is performed, it is possible to use the methods described in the articles by Glafkides, Duffin and Zelikman, or that in *Grundlagen der Photographischan Prozesse mit Silberhalogenidemulsionen,* by Frieser (A kademische verlagnesellschaft, 1968).

It is very important in the present invention that the S layer be positioned toward the exposure side from the L layer and that the amount of silver halide in the S layer, the amount thereof in the L layer and the total amount thereof in the S and L layers be 60–5 weight %, 40–95 weight % and no less than 80 weight %, respectively relative to the total amount of silver halide in the photosensitive element since it is only when these conditions are met that the good effect of the present invention can be obtained. Insofar as the S layer is positioned toward the exposure side from the L layer, other layers having desirable characteristics can be positioned between the S layer and the L layer, or inside or outside of said layers. For example, an L′ layer or an S′ layer which contains less than 20 weight % of the total amount of the silver halide contained in the photosensitive element may be positioned in the order of the L′ layer, the S layer and the L layer, or in the order of the S layer, the L layer and the S′ layer from the exposure side. In particular, it is preferable to form a protective layer on the silver halide emulsion layer in the present invention. For example, a desirable arrangement is for a protective layer consisting of gelatin, the S layer, an intermediate layer consisting of gelatin and the L layer to be provided in this order from the exposure side. The protective layer is made of a hydrophilic polymer such as gelatin or the like and can contain a matting agent such as silica, polymethylmethacrylate latex or the like, or lubricants.

Where the total amount of silver halide in the S layer and the L layer is equal to the total amount of silver halide in the photosensitive element, the amount of silver halide in the S layer and the L layer and total amount thereof are preferably 0.03–1.8 g/m$^2$, 0.15–2.8 g/m$^2$ and 0.3–3.0 g/m$^2$, more preferably 0.03–0.9 g/m$^2$, 0.15–1.4 g/m$^2$ and 0.3–1.5 g/m$^2$, most preferably 0.04–0.5 g/m$^2$, 0.3–1.0 g/m$^2$ and 0.4–1.1 g/m$^2$, respectively, calculated as Ag weight.

The above-described photosensitive element of the present invention together with, if necessary, other layers is applied to a support, thereby to obtain a photosensitive material. Specifically, there can be prepared a photosensitive material which comprises the L layer, the S layer and a protective layer thereon, these three layers being applied on one surface of a support on the opposite surface of which are applied a carbon black layer and a protective layer, the support having subbing layers on both surfaces. In addition, there can be used the method described in *Research Disclosure,* vol 176, 17643, P27–28, "Coating and drying procedures". The support described in *Research Disclosure,* vol 176, 17643 P28, "Supports" can also be used.

Optional Additives

If desired, there can be added antifoggants, polymer dispersants, surfactants, spectral sensitizers, hardeners, dyes or the like to the photosensitive element.

Antifoggant

This agent is added to the photosensitive element in order to restrict the production of fog during preparation, preservation and development of the photosensitive element, and to stabilize the photographic performance. Examples of antifoggants include azoles such as benzothiazoliums, nitroimidazoles, nitrobenzimidazoles, chlorobenzimidazoles, homobenzimidazoles, mercaptothiazoles, mercaptobenzimidazoles, mercaptothiadiazoles, aminotriazoles, benzotriazoles, nitrobenzotriazoles, mercaptotrazoles (in particular, 1-phenyl-5-mercaptotetrazole) and the like; mercaptopyrimidines; mercaptotriazines; thioketo compounds such as oxadorinethione; azaindenes such as triazaindenes, tetraazaindenes (in particular, 4-hydroxy-substituted (1, 3, 3a, 7) tetraazaindenes), pentaazaindenes and the like; benzenethiosulfonic acid, benzenesulfinic acid, benzenesulfonic amido, and any other compounds which are well-known as antifoggants as well as stabilizers such as lipoic acid as described in Japanese Patent Publication No. 25339/1976.

More concrete examples and methods for use thereof are describedin, for example, U.S. Pat Nos. 3,954,474, 3,982,947 and Japense Patent Publication No. 28660/1977, and these can be used in the present invention.

Polymer dispersant

Any dispersant of a water-insoluble or hardly soluble synthetic polymer can be added to the photographic emulsion layer and other hydrophilic colloidal layers for improving the dimensional stability and other purposes. For example, there can be used any kind of dispersant which contains a polymer made from a monomer selected from the group consisting of alkylacrylate, alkylmethacrylate, alkoxyalkylacrylate, alkoxyalkylmethacrylate, glycidylacrylate, glycidyl methacrylate, acrylamido, methacrylamido, vinyl ester such as vinyl acetate, acrylonitrile, olefins, styrene and others, and combinations thereof, and combinations of such a monomer with an other monomer selected from acrylic acid, methacrylic acid, $\alpha,\beta$-unsaturated dicarboxylic acids, hydroxyalkyl acrylates, hydroxyalkyl methacrylates, sulfo alkylacrylates, sulfo alkylmethacrylates, styrenesulfonic acid and the like.

Surfactant

As a coating agent, an antistatic agent or for the purpose of improving slippage, dispersing the emulsion or preventing adhesion, any kind of surfactant can be used in the present invention. Examples of these surfactants are shown as follows: nonionic surfactants such as saponin (steroid series), alkylene oxide derivatives (for example, polyethylene glycols, polyethylene glycols/-polypropylene glycols condensation products, polyethylene glycol alkyl ethers, polyethylene glycol acryl ethers, polyethylene glycol ethers, polyethylene glycol sorbitan esters, polyalkylene glycol alkyl amines and amidos, polyethylene oxide addition products of silicone), glycidol derivatives (for example, alkenyl succinic polyglyceride, alkylphenol polyglyceride), aliphatic esters of polyhydroxy alcohol, alkylesters of sugars and the like; anionic surfactants having a acidic group such as carboxylic group, sulfo group, phospho group, sulfate group, phosphate ester group, etc., for example, alkyl carboxylates, alkyl sulfonates, alkylbenzene sulfonates, alkylnaphthalene sulfonates, alkyl sulfates, alkyl phosphate esters, N-acryl-N-alkyl taurines, sulfo succinic esters, sulfo alkyl polyoxyethylene alkylphenyl esters, polyoxyethylene alkyl phosphate esters and the like; amphoteric surfactants such as amino acids, amino alkylsulfonic acids, amino alkyl sulfates, amino alkyl phosphate esters, alkyl betaines, amine oxides and the like; cationic surfactants such as alkyl amine salts, aliphatic and aromatic quaternary ammonium salts, heterocyclic quaternary ammonium salts such as pyridinium and imidazolinium, aliphatic and heterocyclic phosphonium salts, or sulfonium salts.

Spectral sensitizer

For the purpose of spectrally sensitizing the photographic emulsion, there can be used methine dye, cyanine dye, merocyamine dye, complex cyanine dye, complex merocyanine dye, holopolar cyanine dye, hemicyanine dye, styryl dye, hemioxonol dye and the like. Particularlly useful dyes include cyanine dye, merocyanine dye and complex merocyanine dye.

In the present invention, it is preferable to use plural dyes in the manner that is described in Japanese Patent Application No. 114533/1984.

Hardener

There can be used inorganic and organic hardeners, for example, chromium salts (such as chromium alum, chromium acetate), aldehydes (such as formaldehyde, glyoxal and glutaraldehyde), N-methylol compound (such as dimethylol urea, methylol dimethyl hydantoin), dioxane derivatives (such as 2,3-dihydroxydiorane), active vinyl compounds (such as 1,3,5-triacryloyl-hexahydro-S-triazine, 1,3-vinyl sulfonyl-2-propanol), active halide compounds (such as 2,4-dichrolo-6-hydroxy-S-triazine), mucohalogenic acids (such as mucochloric acid and mucophenoxychloric acid). These compounds can be used individually or in combination.

Dye

As a filter dye, or for the purpose of preventing irradiation or for other purposes, dyes and U.V light absorbers can be added to the photosensitive element of the present invention.

Method for using the photosensitive element of the present invention

A photosensitive material containing the photosensitive element of the present invention can be used together with the following developing agents, silver halide solvents and image-receiving layer (image-receiving material).

Developing agent

It is preferable to use a hydroxylamine developing agent. The hydroxylamine developing agent, when used in combination with a silver image-receiving layer of regenerated cellulose, is particularly useful in forming a silver transferred image which requires no or almost no after-treatment.

Examples of particularly useful hydroxylamine developing agents include N-alkyl- and N-alkoxyalkyl-substituted hydroxylamines. Many hydroxylamines of this kind are described in U.S. Pat. Nos. 2,857,274, 2,857,275, 2,857,276, 3,287,142, 3,287,125, 3,293,034, 3,362,961 and 3,740,221. Hydroxylamine developing agents which are particularly effective and desirable can be represented by the general formula:

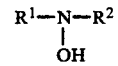

wherein $R^1$ is an alkyl, alkoxyalkyl or alkoxyalkoxyalkyl group; and $R^2$ is a hydrogen atom, or an alkyl, alkoxyalkyl, alkoxyalkoxyalkyl or alkenyl group. Each of the alkyl, alkoxy and alkenyl groups preferably has 1 to 3 carbon atoms. Examples of particularly useful hydroxylamine developing agents include N,N-diethylhydroxylamine, N,N-bis-methoxyethylhydroxylamine and N,N-bis-ethoxyethylhydroxylamine.

Co-developing agents such as phenidone compounds, p-aminophenol compounds and ascorbic acid also can be used together with the above-described developing agents.

Silver halide solvent

There can be used alkali metal thiosulfates, for example sodium thiosulfate or potassium thiosulfate, preferably cyclic amides such as uracil, urazole and 5-methyluracil described in detail in the cited U.S. Pat. Nos. 2,857,274, 2,857,275 and 2,857,276.

The processing solution composition contains alkalis, preferably an alkali metal hydroxide such as sodium hydroxide or potassium hydroxide.

When the processing composition is used by being spread as a thin layer between the photosensitive element and the image-receiving element laid thereon, it is preferable that the processing solution composition contain a polymer film-forming agent and a concentrator or a thickener. For this purpose, hydroxyethyl cellulose and sodium carboxymethyl cellulose are particularly useful. These are added to the processing solution in a concentration that is effective for providing a suitable viscosity, by principles well known in the art of diffusion transfer photography. It is also possible to add other aids, such as antifoggants, other toning agents and stabilizers, that are well-known for the silver transfer process. Mercapto compounds, indazole compounds, triazole compounds and the like are useful as antifoggants and toning agents. Particularly useful compounds thereof are described in U.S. Pat. Nos. 3,565,619, 3,756,825, 3,642,473, G.B. Pat. No. 1122158 and West German Patent Application No. 184365.

Where an oxyethylamino compound is added to the processing compound, the storage life of the processing compound can be increased as described in U.S. Pat. No. 3,619,185 issued to Sidney Kasman.

Image receiving layer (material)

In the present invention, it is preferable to use an image receiving layer consisting of regenerated cellulose containing a silver-precipitating agent. An image-receiving element containing an image-receiving layer is illustrated as follows.

The image-receiving element comprises a support which includes a layer of regenerated cellulose containing a silver-precipitating agent. Baryta paper, polyethylene laminated paper, cellulose triacetate, polyesters and the like can be used as the support. For preparing the image-receiving element, the support is first coated with a coating solution containing a dispersed silver-precipitating agent. The coating solution can for example, be a cellulose ester, in particular cellulose diacetate. If necessary, the support can be treated to form a substratum. The cellulose layer thus obtained is then hydrolyzed by treatment with alkali to convert at least the surface in the depthwise direction of the cellulose ester into regenerated cellulose. In a particularly useful embodiment, the unhydrolyzed portion of the cellulose ester layer containing cellulose diacetate may include one or more mercapto compounds which are suitable for improving the tone, stability, and other photographic properties of the silver-transfer image. These mercapto compounds diffuse from their initial position during the inhibition.

If necessary, another hydrophilic polymer layer also can be provided between the hydrolyzed cellulose ester layer containing a silver-precipitating agent, and an underlayer thereof which is a cellulose ester layer or a partially hydrolyzed cellulose ester layer (that can contain the above-described mercapto compounds). Examples of polymers usable for forming the hydrophilic polymer layer include gelatin, gelatin derivatives (such as phthalic gelatin), sugars (such as starch, galacto-mannan, gum arabic, hydroxyethyl cellulose, methyl cellulose, carboxymethyl cellulose, pullulan, hydroxypropyl cellulose), and hydrophilic synthetic polymer (such as polyacrylamido, polymethylacrylamido, poly-N-vinyl pyrrolidone, 2-hydroxyethyl methacrylate).

Furthermore, if necessary, a layer containing an alkali neutralizing agent can be provided. Polymeric acids described in, for example, Japanese Patent Publication No. 33697/1973 or the like can be used for forming such a layer.

Examples of suitable silver-precipitating agents include heavy metals, such as iron, lead, zinc, nickel, cadmium, tin, chromium, copper and cobalt, and in particular noble metals such as gold, silver, platinum, palladium, etc. Examples of other useful silver-precipitating agents are heavy metal sulfides and selenides, in particular sulfides of mercury, copper, aluminum, zinc, cadmium, cobalt, nickel, silver, lead, antimony, bismuth, cerium and magnesium, and selenides of lead, zinc, antimony and nickel. Working of the silver-precipitating agent in silver halide diffusion transfer process is described in, for example, U.S. Pat. No. 2,774,667 published on Dec. 18, 1956.

The image-receiving element, if necessary, can contain any of various additives such as hardeners, fluorescent whitening agents and coating aids.

Exposure

The exposure for forming the photographic image can be carried out in the usual manner. Namely, it is possible to use any of known light sources such as natural light (sunlight), tungsten lamps, fluorescent lamps, mercury vapor lamps, xenon arc lamps, carbon arc lamps, xenon lamps, the flying spot of a cathode-ray tube, etc. It is possible to use any of the exposure time from 1/1,000 to 1 sec which are usually used for cameras, as well as exposure times of less than 1/1,000 sec, such as exposure times of $1/10^4$ to $1/10^6$ sec, using a xenon flash lamp or cathode-ray tube, and also exposure times of longer than 1 sec. If desired, it is also possible to control the spectral energy distribution of the light used for the exposure with a color filter. It is also possible to use a laser beam for the exposure, or perform the exposure with light emitted from a fluorescent substance excited by electron beams, X-rays, $\gamma$-rays, etc.

When an image is formed by using the photosensitive element of the present invention, a highly sensitive image having fine graininess and high quality can be obtained. Accordingly, the photosensitive element of the present invention can be preferably used for portraits for identification, photomicrographs, photographing CRT picture of ultrasonograph, and other such applications requiring an image of high quality.

The present invention will now be described in more detail with reference to an example but it should be understood that the invention is not limited to this example.

EXAMPLE

Preparation of an emulsion containing silver halide having small grain size (emulsion No. 1)

| | | |
|---|---|---|
| Solution A (60° C.): | water | 600 cc |
| | gelatin | 16 g |
| | KBr | 8 g |
| | KI | 3.4 g |
| Solution B (50° C.): | KBr | 70 g |
| | water | 300 cc |
| Solution C (50° C.): | $AgNO_3$ | 100 g |
| | water | 300 g |

Solutions B and C were simultaneously added over 30 minutes to solution A maintained a temperature of 60° C. and agitated continuously during the addition. Physical ripening was conducted for ten minutes to carry out desalting treatment, after which chemical ripening was conducted. As a result, silver iodobromide emulsion (iodine content: 3.5 mol%) was obtained. The average grain size of the silver halide grains contained in the emulsion was 0.6 $\mu$m. The average grain size was defined as the grain diameter for spherical silver halide grains, or as the diameter of a circle having an area equal to the projected area of the silver halide grain for cubic and other non-spherical silver halide grains (the same hereinafter).

Preparation of an emulsion containing silver halide having large grain size (No. 2)

| | | |
|---|---|---|
| Solution A' (70° C.): | water | 600 cc |
| | gelatin | 16 g |
| | KBr | 20 g |
| | KI | 6.3 g |
| | Potassium thiocyanate | 1.8 g |
| Solution B' (60° C.): | KBr | 70 g |
| | water | 300 cc |
| Solution C' (60° C.): | $AgNO_3$ | 100 g |
| | water | 300 cc |

Solution B' and C' were simultaneously added over 20 minutes to solution A' maintained a temperature of 70° C. and continuously agitated during the addition. Physical ripening was conducted for 10 minutes to carry out desalting treatment, after which chemical ripening was conducted. As a result, silver iodobromide emulsion (iodine content: 6.5 mol%) was obtained. The average grain size of silver halide grains contained in the emulsion was 1.20 $\mu$m.

Process for preparing a sheet having light-sensitive layer 200 ml of methanol solution containing 0.02% by weight of 3-{5-chloro-2-[2-ethyl-3-(3-ethyl-2-benzothiazolinylidine)propenyl]-3-benzoxazolio}propane sulfonate, 200 ml of methanol containing 0.02% by weight of 4-{2-[(3-ethylbenzothiazoline-2-indene)-2-methyl-1-propenyl]-3-benzthiazolio}butane sulfonate, 100 ml of aqueous solution containing 1% by weight of 4-hydroxy-6-methyl-1,3,3a,7-tetraazaindene, 10 ml of methanol solution containing 1% by weight of lipoic acid, and 40 ml of aqueous solution containing 4% by weight of 2-hydroxy-1,3-bisvinylsulfonyl propane were added to each of 1 kg of emulsions No. 1 and No. 2 (which contained 0.65 mol of silver halide).

The resulting emulsions No. 1 and No. 2 were coated individually or in combination in the manner described in Table 1. At the same time, a protective layer consisting of gelatin was coated together with said emulsion. In this connection, there was used a support made of black colored polyethyleneterephthalate sheet, which had a subbing layer, a layer consisting of carbon black being coated on the opposite surface of the support to the emulsion coated surface in order to reflect light.

Formation of image

The photosensitive layer sheet thus prepared was laid over an image-receiving layer sheet prepared by the following method, and then the following processing composition was spread in 0.04 mm thickness between the two sheets so that developing was conducted by diffusion transfer process. As a result, a positive image was obtained. 22.4 g of cellulose acetate (degree of acetylation: 55%) and 0.36 g of 3.6-diphenyl-1,4-dimercapto-3H,6H-2,3a,5,6a-tetraazapentalene were dissolved in mixed solvent of 179 ml of acetone and 45 ml of methanol. The resulting solution was applied in 50 ml/m$^2$ thickness of polyethylene-laminated paper, and dried. 24 g of gum arabic was dissolved in mixed solution of 297 ml of water and 297 ml of methanol, after which 6 ml of formalin (concentration 6%) was added to the mixture in order to apply it in 44 ml/m$^2$ thickness on the layer formed above, whereafter the layers were dried.

An alkali solution containing nickel sulfide as a silver-precipitating agent was applied in 25 ml/m$^2$ thickness on the coating thus formed and dried. The sheet was then washed with water, whereby an image-receiving sheet was obtained. The components of the alkali solution used for application:

| | |
|---|---|
| NaOH | 20 g |
| $H_2O$ | 200 ml |
| methanol | 800 ml |
| glycerin | 30 g |
| NiS | 0.06 g |

The silver-precipitating agent additionally contained in the above-described alkali solutions, i.e., nickel sulfide, was prepared by reacting 20% nickel nitrate aqueous solution with 20% sodium sulfide, with sufficient aggitation, in glycerin.

Composition of the processing solution:

| | |
|---|---|
| potassium hydroxide (40% KOH aqueous solution) | 323 cc |
| titanium dioxide | 3 g |
| hydroxyethyl cellulose | 79 g |
| zinc oxide | 9.75 g |
| N,N—bis-methoxyethylhydroxyamine | 75 g |
| triethanol amine solution (ratio of 6.2 by weight of water to 4.5 by weight of triethanol amine) | 17.14 g |
| tetrahydroxylimidinethione | 0.4 g |
| 2,4-dimercaptopyrimidine | 0.35 g |
| uracil | 90 g |
| water | 1193 g |

The reflective concentration of the positive image sample obtained by diffusion transfer process was measured with TCD-type densitometer manufactured by Fuji Photo Film Co., Ltd. so that the sensitivity was calculated from an exposure value corresponding to an optical density 0.1 smaller than the maximum concentration. The sensitivity was represented relative to that of sample No. 1 defined as 100. As for the grain size, which shows the quality of the image, the same subject was photographed under the same conditions and the obtained image was observed by microscope at a magnification of X100, and the grain sizes of the samples were compared with each other.

The constitution of the layers of the photosensitive elements and the results are shown in Tables 1 and 2, respectively.

TABLE 1

| | top layer | | interlayer | | lower layer | |
|---|---|---|---|---|---|---|
| | emulsion No. | amount of silver applied | emulsion No. | amount of silver applied | emulsion No. | amount of silver applied |
| Example | | | | | | |
| 1 | 1 | 0.18 g/m$^2$ | — | — | 2 | 0.42 g/m$^2$ |
| 2 | 1 | 0.07 | — | — | 2 | 0.53 |
| 3 | 2 | 0.03 | 1 | 0.13 | 2 | 0.44 |
| Comparative example | | | | | | |
| 4 | 2 | 0.42 | — | — | 1 | 0.18 |
| 5* | 2 | 0.18 | — | — | — | — |
| | 1 | 0.42 | | | | |

*emulsions No. 1 and No. 2 were mixed

TABLE 2

| | relative sensitivity | grain size |
|---|---|---|
| Example | | |
| 1 | 100 | extremely fine |
| 2 | 110 | " |
| 3 | 105 | fine |
| Comparative example | | |
| 4 | 98 | extremely coarse |
| 5 | 100 | coarse |

As is obvious from tables 1 and 2, all of examples 1 to 3 of the present invention in which the S layer and the L layer contained a specific amount of silver halide and the S layer was positioned on the exposure side of the L layer had better properties than the comparative examples.

What is claimed is:

1. A photosensitive element used for a silver salt diffusion transfer process, which comprises a support, a photosensitive emulsion layer containing silver halide grains of average grain size of 0.15 to 0.7 m (S layer) and another photosensitive emulsion layer containing silver halide grains of average grain size of 0.8 to 3 m (L layer), wherein the S layer is positioned further from the support than the L layer, and the amount of silver halide contained in the S layer, the amount thereof contained in the L layer and the total amount thereof contained in the S and L layer is 60–5 weight %, 40–95 weight %, and no less than 80 weight %, respectively, relative to the total amount of silver halide contained in the photosensitive element.

2. A photographic element as set forth in claim 1 wherein the average grain size of the silver halide grains contained in the S layer is in the range of 0.30 to 0.70 μm, and that of those in the L layer is in the range of 0.8 to 1.7 μm.

3. A photographic element as set forth in claim 1 wherein the difference between the average grain sizes of silver halide grains contained in the S and L layers is no less than 0.3 μm.

4. A photographic element as set forth in claim 1 wherein the total amount of silver halide in the S and L layers is equal to the total amount of silver halide in the photosensitive element.

5. A photosensitive element as set forth in claim 4 wherein the amount of silver halide in the S layer, the amount thereof contained in the L layer and the total amount thereof are 0.03–1.8 g/m$^2$, 0.15–2.8 g/m$^2$ and 0.3–3.0 g/m$^2$, respectively, calculated as Ag weight.

6. A photographic element as set forth in claim 4 wherein the amount of silver halide in the S layer, the amount thereof contained in the L layer, and the total amount thereof are 0.03–0.9 g/m$^2$, 0.15–1.4 g/m$^2$ and 0.3–1.5 g/m$^2$, respectively, calculated as Ag weight.

7. A photographic element as set forth in claim 4 wherein amount of silver halide in the S layer, the amount thereof contained in the L layer, and the total amount thereof are 0.04–0.5 g/m$^2$, 0.3–1.0 g/m$^2$ and 0.4–1.1 g/m$^2$, respectively, calculated as Ag weight.

8. A photographic element as set forth in claim 1 wherein the S layer and the L layer each contains gelatin in such amount that the weight ratio of silver halide to gelatin is from 2/1 to 1/12.

9. A photosensitive element as set forth in claim 1 wherein an intermediate layer containing gelatin is formed between the S layer and the L layer.

10. A photographic element as set forth in claim 1 wherein a protective layer containing gelatin is formed on the S layer.

* * * * *